US006965117B2

(12) United States Patent
Hiramoto

(10) Patent No.: US 6,965,117 B2
(45) Date of Patent: Nov. 15, 2005

(54) EXTREME UV LIGHT SOURCE AND SEMICONDUCTOR EXPOSURE DEVICE

(75) Inventor: Tatumi Hiramoto, Tokyo (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 42 days.

(21) Appl. No.: 10/762,355

(22) Filed: Jan. 23, 2004

(65) Prior Publication Data

US 2004/0149937 A1 Aug. 5, 2004

(30) Foreign Application Priority Data

Jan. 23, 2003 (JP) ..... 2003-014591

(51) Int. Cl.[7] ..... H01J 35/20
(52) U.S. Cl. ..... 250/504 R; 250/493.1; 378/119
(58) Field of Search ..... 250/493.1, 504 R; 378/119

(56) References Cited

U.S. PATENT DOCUMENTS 6,188,076 B1 2/2001 Silfvast et al.
6,356,618 B1 3/2002 Fornaciari et al.
6,586,757 B2 * 7/2003 Melnychuk et al. .... 250/504 R
2003/0006383 A1 * 1/2003 Melnychuk et al. .... 250/504 R
2004/0183037 A1 * 9/2004 Klein et al. ..... 250/504 R

OTHER PUBLICATIONS

Thshihisa Tomie, Plasma Source for Extreme Ultraviolet Lithography, Optics, Japanese Joptices Society, 2002, vol. 31, No. 7, pp. 545-552.

* cited by examiner

*Primary Examiner*—John R. Lee
*Assistant Examiner*—Paul M. Gurzo
(74) *Attorney, Agent, or Firm*—Nixon Peabody LLP; David S. Safran

(57) ABSTRACT

A UV light source in which Xenon (Xe) gas is mixed with a substance which, in the temperature range in which 10-valent Xe ions ($Xe^{10+}$) occur, emits a number of free electrons from a molecule or an atom that at least half the number of electrons which are released from a Xe atom, and which at room temperature is molecular or atomic (for example Ar, Kr, Ne, $N_2$ and $NH_3$). A high voltage is applied in a pulse-like manner to the electrode on the ground side and the electrode on the high voltage side to produce a plasma with a high temperature and from which extreme UV light with a wavelength of 13.5 nm is formed and emitted. The invention can also be used an extreme UV light source of the capillary, plasma focus, and Z pinch types for example.

24 Claims, 13 Drawing Sheets

Unit of gas density: $10^{23}/m^3$ )

| NsKr | 0 | 1.064 | 3.191 | 4.253 |
|---|---|---|---|---|
| NsXe | 0.3 | 0.24 | 0.12 | 0.06 |
| 220eV | 1 | 2.36 | 2.55 | 1.54 |
| 180eV | 1 | 1.98 | 1.84 | 1.08 |
| 120eV | 1 | 1.6 | 1.1 | 0.63 |

Unit of gas density: $10^{23}/m^3$ )

| NsKr | 0 | 3.545 | 7.09 | 10.64 | 14.18 | 15.95 |
|---|---|---|---|---|---|---|
| NsXe | 1 | 0.8 | 0.6 | 0.4 | 0.2 | 0.1 |
| 220eV | 1 | 2.4 | 2.83 | 2.58 | 1.74 | 0.83 |
| 180eV | 1 | 1.94 | 2 | 1.8 | 1.04 | 0.56 |
| 120eV | 1 | 1.45 | 1.39 | 1.08 | 0.68 | 0.32 |

Unit of gas density: $10^{23}/m^3$ )

| NsKr | 0 | 5.318 | 10.635 | 21.27 | 37.23 |
|---|---|---|---|---|---|
| NsXe | 3 | 2.7 | 2.4 | 1.8 | 0.9 |
| 220eV | 1 | 1.8 | 2.36 | 2.68 | 1.92 |
| 180eV | 1 | 1.62 | 1.91 | 2.06 | 1.42 |
| 120eV | 1 | 1.33 | 1.44 | 1.36 | 0.84 |

Unit of gas density: $10^{23}/m^3$ )

| NsKr | 0 | 2.88 | 5.76 | 11.52 |
|---|---|---|---|---|
| NsXe | 1 | 0.8 | 0.6 | 0.2 |
| 220eV | 1 | 1.94 | 2.17 | 1.15 |
| 180eV | 1 | 1.64 | 1.73 | 0.85 |
| 120eV | 1 | 1.29 | 1.21 | 0.52 |

Fig. 13

| | Absorption cross-sectional area of photons with 13.5 nm (Mb) | Number of electrons provided per atom or molecule at a temperature where the density of $Xe^{10+}$ is maximum |
|---|---|---|
| Ne | 4.0 | ca. 6.5 |
| Ar | 1.4 | ca. 8.0 |
| Kr | 1.2 | ca. 9.5 |
| $N_2$ | 2.5 | ca. 8.0 |
| $NH_3$ | 1.2 | ca. 7.0 |
| Xe | 20.7 | ca. 10.6 |
| He | 0.5 | ca. 2.0 |

EXTREME UV LIGHT SOURCE AND SEMICONDUCTOR EXPOSURE DEVICE

BACKGROUND OF THE INVENTION

1. Field of the Invention

The invention relates to an extreme UV light source which is used as the light source of a device for a semiconductor exposure device, and a semiconductor exposure device using this light source. The invention relates especially to an extreme UV light source for which the radiation density of this light source can be increased, and a semiconductor exposure device.

2. Description of the Prior Art

The refinement of circuit parts of components has been continuing recently for purposes of increasing the efficiency of the semiconductor components and reducing their costs.

To do this, the wavelengths of a light source for pattern reduction exposure using light are becoming increasingly shorter. It is proposed that, instead of laser light with wavelengths of roughly 200 nm which is currently being used, extreme UV radiation with a wavelengths of 13.5 nm be used for purposes of semiconductor exposure as the light for the next generations. It is known that this light is formed in a process in which decivalent Xe ions ($Xe^{10+}$) are transferred to a certain level.

However, in the case of using light with a wavelength of 13.5 nm (hereinafter called "13.5 nm light") for purposes of semiconductor exposure, optical lenses cannot be used for the optical system. For example, at present, a semiconductor exposure device is formed by a combination of reflectors with one another which are formed of Mo/Si multilayer films. It is known that, for Mo/Si multilayer films which are currently considered to be optimum, the reflection efficiency of 13.5 nm light is low and that due to repeated reflections less than 10% of the initial light intensity results.

It is also assumed that improvement of the optical system which comprises reflectors will continue in the future. Without an extreme UV radiation light source with high radiation density, the possibility of building a semiconductor exposure device which will withstand practical use in industry is low. An increase of the radiation density of the light source is greatly desired.

This is because, regardless of how the optical system is from the light source to the exposure surface, the irradiance of the exposure surface increases together with an increase of the radiation density of the light source. In order to increase the irradiance for increasing the throughput in an exposure process, and in order to enlarge the exposure area, it is therefore essential to increase the radiation density.

In U.S. Pat. Nos. 6,188,076 and 6,356,618 (hereafter, patents 1 and 2, respectively) an extreme UV light source using a capillary discharge (narrow passage discharge) is described. In both cases, plasmas with a high temperature and a high density are produced by a discharge, resulting in UV light. Moreover, as the extreme UV light source, there is a light source of the plasma focus type, a light source of the Z pinch type, a light source of the hollow cathode tube type, and the like. The publication Toshihisa Tomie, "Plasma light source for extreme UV lithography, Optics, Japanese Optics Society, 2002, vol. 31, number 7, pp. 545 to 552, describes situations, problems and the like in the development of various type of plasma light sources for extreme UV lithography.

In the case of using xenon (Xe) as the operating gas in this extreme UV light source, it can be imagined, first, that the Xe pressure of the operating gas is increased for increasing the radiation density. Xe, on the one hand, has the property that it emits 13.5 nm light. However, on the other hand, it has the opposite property that, in contrast, it relatively strongly absorbs the additionally emitted 13.5 nm light.

If the Xe pressure as the operating gas is increased, it can be imagined that the space from the vicinity of the open end of the capillary (narrow, small passage) from which the 13.5 nm light is emitted, is completely filled with Xe up to the irradiated surface and that, in this way, a layer is formed which absorbs 13.5 nm light.

Therefore, it becomes necessary to evacuate excess Xe with an evacuation pump and to reduce the Xe in the space from the vicinity of the open end of the capillary (narrow, small passage) up to the irradiated surface; this leads to an increase of the load of the evacuation pump (enlargement). As a result, the extreme UV light source becomes larger; this is considered disadvantageous with respect to the arrangement of the device. If an evacuation system with an excessively high evacuation rate is used, the Xe pressure in the discharge part also decreases, resulting in the disadvantage that a reduction of the radiation density is induced. This means that absorption of the 13.5 mm light seemed to a certain extent inevitable.

FIG. 11 shows the particle density of Xe ions at the temperature at which a plasma is attained (labeled eV), in the case in which, for plasma-like Xe, the average atomic density of Xe in the capillary (in a narrow passage) is $1\times10^{23}/m^3$. The presence of Xe ions with a valency of at least 14 was ignored in any case.

In FIG. 11, the curves 1+ to 13+ each plot the ion particle density of monovalent to 13-valent Xe. When the temperature is, for example, roughly 17 eV, the 10-valent Xe ions ($Xe^{10+}$) have a maximum.

As is shown in FIG. 11, from an area with a low temperature, the ions of the monovalent state occur proceeding in an ascending sequence. If, here, 10-valent Xe ions ($Xe^{10+}$) on the electron orbit pass from an initial level with a certain height to a level which is 91.8 eV lower, extreme UV light of 13.5 nm is emitted.

FIG. 12 shows the spectral radiation density of 13.5 nm light from a black body. FIG. 12 plots the temperature (eV) on the x axis and the spectral radiation density ($W/mm^2 \cdot 0.1$ nm·sr) on the y axis. As is shown in FIG. 12, the spectral radiation density of the 13.5 nm light from a black body increases monotonically according to the temperature increase. In the case of optically thin plasmas, the radiation density of the extreme UV light with 13.5 nm which is emitted by the above described 10-valent Xe ions ($Xe^{10+}$) is proportional to the product of the ion density in FIG. 11 and the radiation density of the black body in FIG. 12.

Since the radiation density of the black body has high temperature dependency, it can be imagined that the radiation density of the extreme UV light with a 13.5 nm wavelength can be increased when the peak position temperature of the 10-valent Xe ions ($Xe^{10+}$) shown in FIG. 11 is shifted to the side with a high temperature.

Conventionally, it can be imagined that the peak position of the 10-valent Xe ions ($Xe^{10+}$) can be shifted to the side with the high temperature, if the average atomic density of Xe in a small, narrow passage increases (the pressure is increased). If the pressure is increased, the peak position of the 10-valent Xe ions ($Xe^{10+}$) can be shifted to the side with a high temperature with certainty. However, the ratio of the absorption of the 13.5 nm light increases when the pressure is increased.

In order to increase the radiation density, for a normal light source, the plasma temperature must be increased or the density of the emission substance must be increased. However, in the case of using ion emission, these ions ionize into ions with a higher dimension and are thus reduced when the temperature is excessively increased. This means that, under certain conditions of atomic density, a maximally high radiation density is fixed, and it is not possible to go higher.

To increase the radiation density, therefore, it is necessary to increase the density of the emission substance, i.e., the atomic density. The particle density of the atomic or molecular substance which becomes the source of the emission substance increases in the space from the light source to the exposure surface. In this way, the re-absorption of radiation is increased, as was described above. Therefore, this also has an upper boundary somewhere.

SUMMARY OF THE INVENTION

The invention was devised to push the above noted upper boundary higher. Thus, a primary object of the present invention is to devise an extreme UV light source in which the emission of extreme UV radiation with a wavelength of 13.5 nm with increased radiation density is enabled without increasing the pressure of Xe with a large absorption cross-sectional area of photons of 13.5 nm light.

The inventor observed the absorption cross-sectional area of photons of 13.5 nm light for various types of gaseous substance. The expression "absorption cross-sectional area of photons of 13.5 nm light" is defined as the amount of absorption of photons of light with a wavelength of 13.5 nm in an optical path by an atom or a molecule and the unit is labeled b (barn) and Mb (megabarn).

FIG. 13 shows the absorption cross-sectional areas of photons with a wavelength of 13.5 nm of different types of gases and the numbers of electrons supplied per atom or molecule in the temperature range in which the particle density of ($Xe^{10+}$) becomes maximum. As is shown in FIG. 13, the absorption cross-sectional areas of photons of Kr, Ar, Ne, $N_2$ and $NH_3$ are smaller in comparison to Xe. Furthermore, the number of electrons supplied per atom or molecule in the vicinity of the temperature at which the particle density of 10-valent ions ($Xe^{10+}$) of Xe becomes maximum, for Kr, Ar, Ne, $N_2$ and $NH_3$ is greater than or equal to half of roughly 10.6 for Xe.

When the above described substances besides Xe are mixed in and when the number of electrons which have been supplied by the above described substance which has been mixed in is large, it can be imagined that, thus, the ionization of Xe ions is suppressed and that, in this way, the temperature at which the particle density of the 10-valent ions ($Xe^{10+}$) is maximum is shifted to a higher temperature. Furthermore, it can be imagined that, for this reason, a substance for electron supply with a small absorption cross-sectional area must be chosen.

Therefore, it is necessary to select the substance which is to be mixed into the Xe from substances which are molecular or atomic at room temperature (for example, from Kr, Ar, Ne, $N_2$ and $NH_3$ as shown in FIG. 13) and which in the temperature range in which 10-valent Xe ions ($Xe^{10+}$) occur (for example, in a temperature range within an area of a few eV in the vicinity of the temperature at which the particle density of ($Xe^{10+}$) is maximum) emit from a molecule or an atom free electrons with a number of at least half of the number of electrons which are released from a Xe atom.

By mixing in such a substance, it is expected that ionization of the Xe ions into a stage with a higher dimension (charging) will be suppressed so that, in this way, the temperature at which the particle density of the 10-valent ions ($Xe^{10+}$) is maximum, will be shifted to a higher temperature and that the radiation density of the extreme UV light increased.

As the ionized state of the plasmas which can be used in accordance with the invention, there is a case in which the ionization of the ions of each step is associated with the temperature and the electron density of the plasmas. It is, for example, the state in which the velocity of the three-body collision recombination which involves two electrons and one cation cannot be completely ignored as compared to the velocity of other recombinations.

This state exists to an adequate degree at local thermal equilibrium. However, the invention can also be used for a region with a relatively great electron density even in a collision radiation model. The expression "condition under which three-body collision recombination cannot be ignored" is defined as the state in which the ratio $R_3/R_r$ of the three-body collision recombination ($R_3$) to the radiation recombination ($R_r$) is at least 0.2, which is described, for example, on pp. 60 to 64 of *Gas Discharge Physics* (Y. P. Raizer, Springer-Verlag Berlin Heidelberg 1991).

If the temperature at which the radiation of the 10-valent Xe ions at 13.5 nm becomes maximum is fixed at 17 eV, as was described above, under this condition, the electron density is at least $2.5\times10^{17}/cm^3$. Since, here, the number of supplied electrons is 10.6 (according to the table in FIG. 13), at 1/10.6 times the atomic density, i.e., at an atomic density of at least $2.4\times10^{16}/cm^3$, the condition under which the invention can be used is obtained.

Furthermore, if the average atomic density of Xe in a narrow, small passage is at least $2.4\times10^{16}/cm^3$ ($2.4\times10^{22}/m^3$), a state with a high ion density is obtained, by which a three-body collision in which electrons are involved as two bodies can be easily formed. In this way, ionization of the Xe ions is suppressed, and the temperature at which the particle density of the 10-valent Xe ions ($Xe^{10+}$) is maximum is shifted to a higher temperature, by which the radiation density of the extreme UV light increases.

Based on the above described circumstances the above described object is achieved in accordance with the invention as follows:

(1) A plasma is produced in a gas mixture in which a substance is mixed into Xe, which substance is molecular or atomic at room temperature and which, in the temperature range in which 10-valent Xe ions ($Xe^{10+}$) occur, emits from a molecule or an atom, a number of free electrons that is at least half the number of electrons which are released from a Xe atom. Extreme UV radiation with a wavelength of 13.5 nm which is emitted by 10-valent Xe ions ($Xe^{10+}$) which form in this plasma is emitted.

(2) At least one of the gases Ar, Kr, Ne, $N_2$ and $NH_3$ is mixed into Xe. In the gas mixture, a plasma is produced. Extreme UV radiation is emitted with a wavelength of 13.5 nm which is emitted by the 10-valent Xe ions ($Xe^{10+}$) which form in this plasma.

(3) In the above described solutions (1) and (2), the gas mixture passes through the inside of a narrow small passage which is located between a first electrode and a second electrode. In this narrow small passage, a discharge and thus a plasma, are produced. Extreme UV radiation with a wavelength of 13.5 nm which is emitted by the 10-valent Xe ions ($Xe^{10+}$) which form in this plasma is emitted.

(4) In the above described solution (3), the average atomic density of Xe in the above described gas mixture in the narrow, small passage is fixed at a value that is at least $2.4\times10^{22}/m^3$.

(5) In the above described solution (3), extreme UV radiation is used which is emitted in the direction of flow of the gas mixture of the above described narrow small passage.

(6) In the above described solutions (3) to (5), the gas mixture is mixed by way of preparation before it passes into the above described narrow small passage.

(7) In the above described solutions (3) to (6), the space in which gas is supplied to the narrow small passage is transferred into an atmosphere with at least one of the gases Ar, Kr, Ne, $N_2$ and $NH_3$ or into a Xe gas atmosphere. If the above described space is transferred into an atmosphere with at least one of the gases Ar, Kr, Ne, $N_2$ and $NH_3$, Xe is mixed in before entering the above described narrow small passage. If the above described space is transferred into a Xe gas atmosphere, at least one of the gases Ar, Kr, Ne, $N_2$ and $NH_3$ is mixed in before entering the above described narrow small passage.

(8) The above described solutions (1) and (2) are used for an extreme UV light source of the Z pinch type. The above described gas mixture is routed into a cylindrical vessel which is located between the first electrode and the second electrode. The average atomic density of Xe in the gas mixture in this cylindrical vessel is fixed at a value of at least $2.4\times10^{22}/m^3$.

(9) The above described solutions (1) and (2) are used for an extreme UV light source of the plasma focus type. The above described gas mixture is routed into a middle through opening of an inside cylindrical electrode. The average atomic density of Xe in the gas mixture of the focusing part of the high temperature plasma which is formed in the gas emission-side tip area of this inside cylindrical electrode is fixed at a value of at least $2.4\times10^{22}/m^3$.

(10) The extreme UV light sources described above in (1) to (7) are combined with reflectors and a mask, and thus, a semiconductor exposure device is formed.

The plasmas which can be used in accordance with the invention can also be used for plasmas which have been produced by a process besides this capillary discharge. In spite of this production process, for "plasmas in a state in which three-body collision recombination cannot be ignored", an application can be found specifically for plasmas with a Xe atomic density of at least $2.4\times10^{22}/m^3$. Here, for purposes of simplification, plasmas are described by way of example which are found locally in a state of thermal equilibrium.

The increase of the radiation density by the process of the invention is effective regardless of the discharge type for all light sources in which Xe is used as the emission substance.

The invention is further described below with reference to the accompanying drawings.

BRIEF DESCRIPTION OF THE DRAWINGS

FIG. 13 is a table which shows the absorption cross-sectional areas of photons with a wavelength of 13.5 nm for different types of gases and the number of electrons supplied.

DETAILED DESCRIPTION OF THE INVENTION

Figure 1:
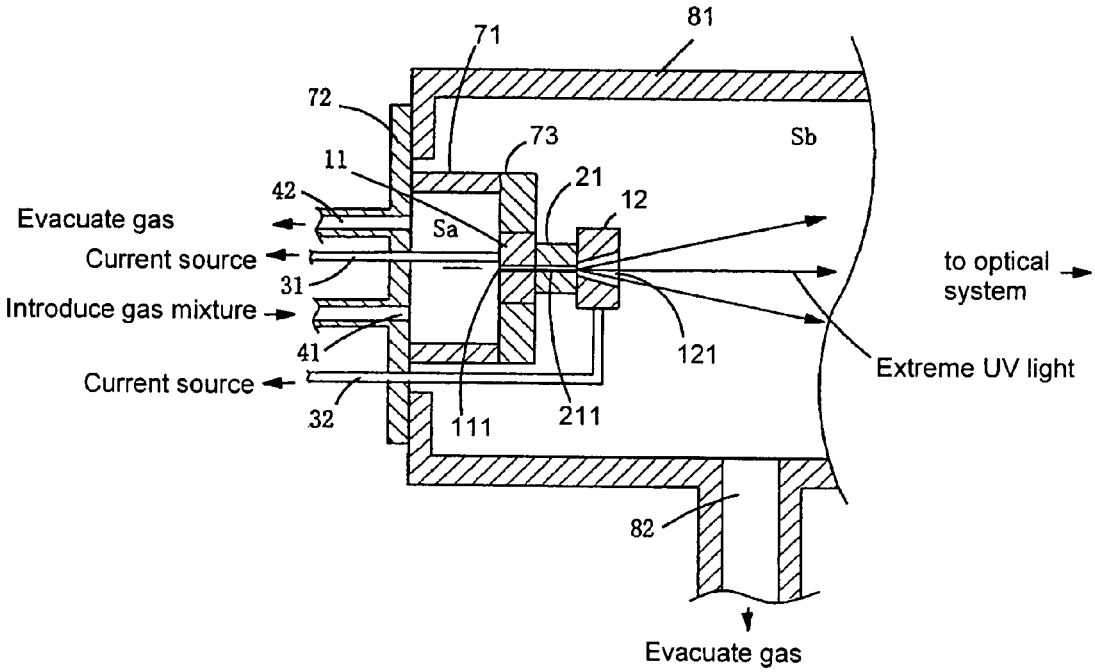
FIG. 1 shows a schematic of one example of an arrangement of an extreme UV light source for which the invention is used.

FIG. 1 is a schematic of one example of an arrangement of an extreme UV light source using a capillary discharge with which the invention is used. FIG. 1 is a cross section which is cut by a plane which passes through the optical axis of the extreme UV light which is emitted from the extreme UV light source.

As is shown in FIG. 1, between the first electrode 11 and the second electrode 12, for example, of tungsten, there is a capillary body 21 which is a cylindrical insulation body which is made, for example, of silicon nitride or the like and which has a capillary 211 with a diameter of 3 mm in the middle. The material for the electrodes 11, 12 can also be tantalum. The material for the capillary body 21 can also be aluminum nitride or diamond.

A current source (not shown) is electrically connected to the first electrode 11 and the second electrode 12 via electrical lines 31, 32. Between the first electrode 11 and the second electrode 12, a high voltage is applied in a pulse from this current source. The second electrode is normally grounded, and for example, a negative high voltage is applied to the first electrode in the manner of a pulse. Hereinafter, the first electrode is called the "electrode on the high voltage side" and the second electrode is called the "electrode on the ground side".

The electrode on the high voltage side 11 and the electrode on the ground side 12 each have through openings 111 and 121. These through openings 111, 121 and the capillary 211 of the capillary body 21 are arranged coaxially and are continuously connected to one another.

The electrode on the high voltage side 11 is installed in an insulating plate 73 which is mounted in a separating cylinder 71 which is attached to a bottom plate 72. The electrode on the high voltage side 11, the insulating plate 73, the separating cylinder 71 and the bottom plate 72 form a closed space Sa. This closed space is a so-called plenum chamber. The bottom plate 72 is provided with through openings for passage of the electric lines 31, 32, with a gas feed line 41 for feeding the gas mixture into the closed space Sa, and with an evacuation opening 42.

The gas feed opening 41 feeds a gas mixture composed of an operating gas, for example, xenon (Xe), and of at least one of the gases Ar, Kr, Ne, $N_2$ and $NH_3$. The gas is withdrawn from the evacuation opening 42. It is controlled such that the pressure in the closed space Sa has a suitable value. The bottom plate 72 is hermetically connected to an outer surrounding cylinder 81, by which a space Sb is formed which is shielded from the outside environment. The outside surrounding cylinder 81 is provided with an evacuation opening 82. The operating gas in the space Sa flows via the through openings 111, 121 which have been formed in the electrodes 11, 12 and via the capillaries 211 into the space Sb and is withdrawn through the evacuation opening 82.

After the space Sa and the space Sb have been evacuated beforehand, in the space Sa, krypton (Kr) in a given amount is mixed in by way of preparation and afterward fed from the gas feed opening 41 into the operating gas which is necessary for discharge, for example, xenon (Xe). When the gas is mixed in this preparatory manner, the composition of the gas becomes uniform in the narrow, small passage which is formed between the electrode on the high voltage side 11 and the electrode on the ground side 12, and which formed of a through opening 111, a capillary 211 and the like.

The gas can be evacuated from the gas outlet opening 42. The pressure in the space Sa is controlled such that a pressure which is suitable for discharge, for example, a few 1000 Pa, is achieved. This can be achieved by a known process in which the flow amount of gas feed is controlled, or by similar processes.

If a high voltage is applied in a pulse-like manner to the electrode on the high voltage side 11 and the electrode on the ground side 12, while operating gas flows into the through openings 111, 121 and the capillary 211, a gas discharge forms in the capillary 211, by which high temperature plasmas are formed. This yields extreme UV light with a wavelength of 13.5 nm. This extreme UV light is emitted into the space Sb.

The gas mixture which has flowed from the through opening 121 of the electrode on the ground side 12 into the space Sb is, as was described above, evacuated from the evacuation opening 82 with high velocity. Thus, the space Sb is transferred into a high vacuum state which is free of perturbations for passage of the extreme UV light. The opening in the area of the capillary 211 is orifice-like and has a differential evacuation arrangement. In this way, extreme UV light is used which is emitted in the flow direction of the gas mixture in the narrow, small passage which is formed between the electrode on the high voltage side 11 and the electrode on the ground side 12.

By feeding a gas mixture composed of xenon (Xe) gas and at least one of the gases Ar, Kr, Ne, $N_2$ and $NH_3$ in the narrow, small passage which is formed between the electrode on the high voltage side 11 and the electrode on the ground side 12, in the above described manner for the extreme UV light source in this embodiment, the temperature at which the particle density of the 10-valent Xe ions ($Xe^{10+}$) becomes maximum, is shifted to a higher temperature, and thus, the radiation density of the extreme UV light is increased.

The inventive idea about emission of extreme UV light in the above described extreme UV light source at the existing local thermal equilibrium (LTE) is described below using one example.

The radiance I (Te) at a temperature Te of a spectral line at which the wave length λo=13.5 nm which is emitted by the 10-valent Xe ions is represented by the formula (1) below (the integral range is 0 to ∞) when the radiation density of the black body is B (λo, Te), where the density of the 10-valent ions (particles) of Xe is N (10), the energy of the lower level with respect to the radiation of this spectral line is E1 (eV) and the profile function of the line is P(Δλ), and when induced emission is ignored because it is small. Here, in formula (1), A is the constant which is characteristic of this line, and L is the length of a plasma column. In an optically thin state, an approximation computation is performed, by which formula (1) becomes formula (2) which is described next. In formula (2), C denotes the constant.

(Formulas)

$$I(Te)=\int_0^\infty B(\lambda_0,Te)[1-\exp\{-A\cdot L\cdot N(10)\cdot\exp\{-E_1/Te)\}\cdot P(\Delta\lambda)\}]d\lambda \quad (1)$$

$$I(Te)=C\cdot L\cdot B(\lambda_0,Te)\cdot N(10)\cdot\exp\{-(E_1/Te) \quad (2)$$

Here, the radiation density is identical to the sum of the ion densities of all ionization stages during the discharge for the Xe gas (particle) density. Since the discharge takes place in an extremely short time, it is essentially identical to the Xe (particle) density in the discharge area immediately before starting the discharge, or it can be computed by multiplying the compression factor by the above described density when plasma compression (a pinch) forms.

When the density NsXe of the Xe is increased, the radiation density I also increases. NsXe denotes the gas density (number of atoms/$m^3$) of Xe before discharge. Below, Ns is the gas density, for example, the gas density of Xe is designated NsXe and the gas density of Kr is labeled NsKr.

Figure 11:
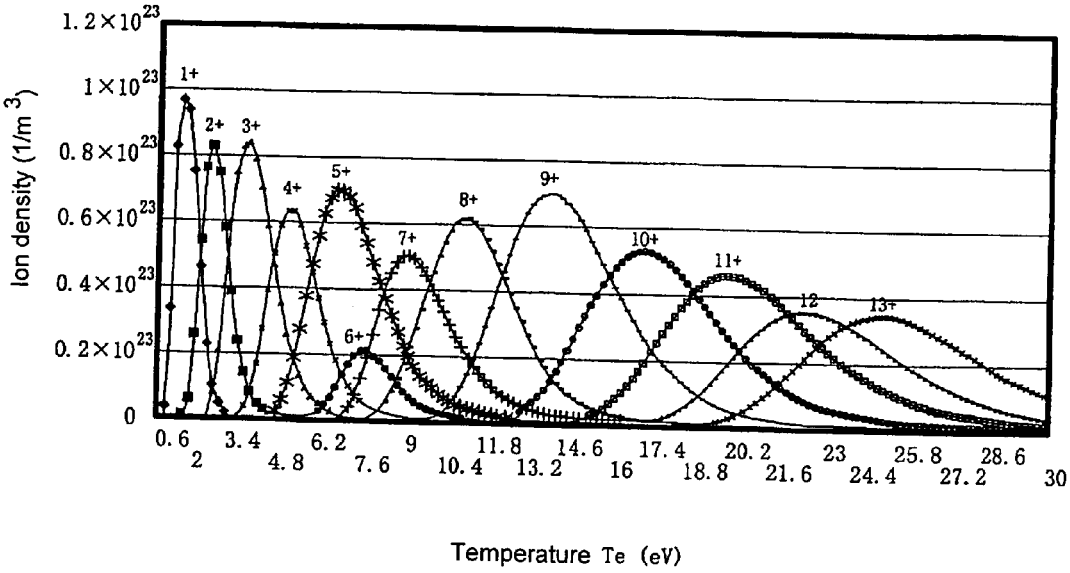
FIG. 11 depicts the relation between the Xe ion density and temperature.
Figure 12:
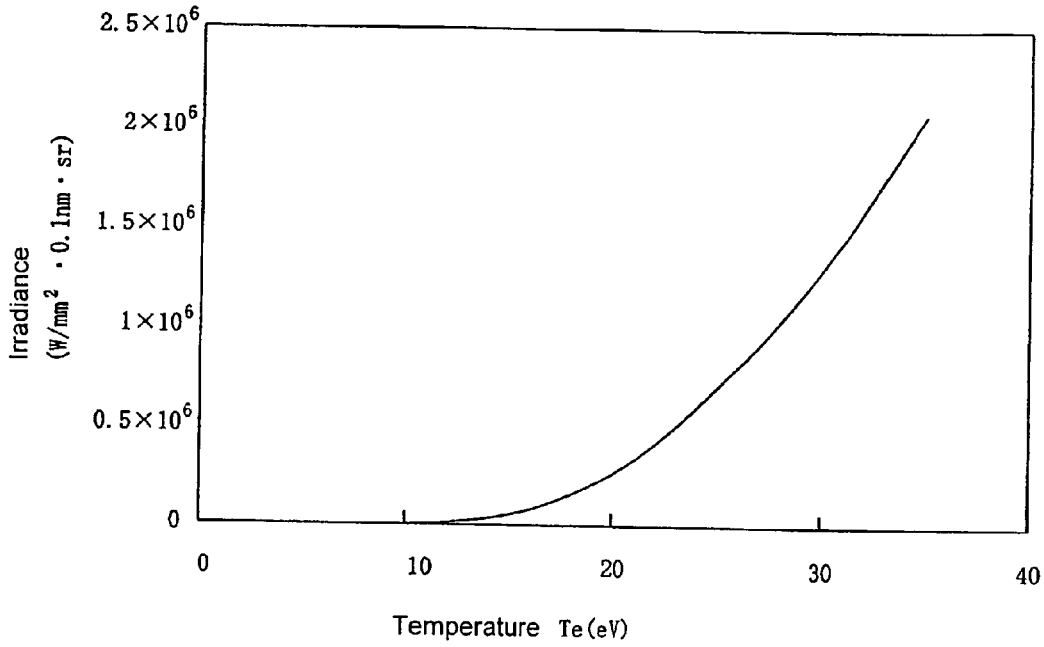
FIG. 12 is a plot of the relation between the radiation density of a black body and the temperature.

The reason for this is that the radiation density of the black body B ($\lambda_0$, Te) increases monotonically according to the temperature increase, and that the temperature at which $N(10)\cdot\exp(-E_1/Te)$ becomes maximum (see the peak of $Xe^{10+}$ as shown in FIG. 11) is shifted to the high temperature side.

However, the Xe atoms (as was explained above using the table in FIG. 13) have a relatively large absorption cross-sectional area of photons with a wavelength 13.5 nm. An excess increase of NsXe therefore leads to great attenuation of the radiation in the optical path from the light source to the article which is to be exposed (for example, a resist). The 13.5 nm light is attenuated, for example, in FIG. 1 in the optical path from the through opening 121 to the exposure optics system.

Therefore, the Xe pressure in the optical path must be kept at less than or equal to 0.1 Pa. The pressure ratio of the plasma discharge area to the optical path is, however, roughly $10^4$, by which the diameter of the opening of the capillary 211 which forms a differential evacuation area is extremely small. This means that the repulsion of the light (shielding of the light) by the inside wall of the capillary 211 becomes great, by which the device can no longer be used. Finally NsXe also has an upper limit in practice. The reason for increasing the radiation density by increasing the NsXe is originally the fact that the electron density increases and that for each stage the ionization of the ions is suppressed.

As a result of the equilibrium property of the reaction, the reaction continues in the direction in which the electron density decreases when the electron density increases at a certain temperature. In order to make the degree of electrolytic dissociation of the ions constant at any stage, the temperature must also be increased according to the increase of NsXe.

This means that the temperature at which the peak of the density N(10) of the 10-valent Xe ions appears is shifted to the high temperature side. In this way, the radiation density of the black body and also the Boltzmann factor increase. As a result, the radiation density is increased.

As is shown using the table in FIG. 13, Ar and Kr have smaller absorption cross-sectional areas of photons with a 13.5 nm wavelength than Xe. For example Kr has an absorption cross-sectional area of photons with a 13.5 nm wavelength that is roughly 1/18 that of Xe. This results in that the absorption cross-sectional area of photons with 13.5 nm is increased only by 1.56 times, even if krypton is added to the Xe in 10 times the amount.

Therefore, in accordance with the invention, the density of Xe which is the actual emission substance is reduced to a certain amount, and instead, the operating gas is produced by a substance with a small absorption cross-sectional area of photons with 13.5 nm having been mixed in.

When a gas with a small absorption cross-sectional area of photons with wavelength of 13.5 nm is mixed in such that the absorption coefficient is identical to that of the original Xe element, the particle density of this mixed-in gas, of course, becomes greater than the reduced particle density of Xe. When these mixed-in atoms or these mixed-in molecules during discharge ionize a sufficient number of electrons, it is possible for the electron density to increase more than solely for the original Xe.

Then, this means that the radiation density also increases. It can be assumed that, for this effect, Kr is suitable; it can emit many electrons (from one atom roughly 9.5) in the temperature range in which the density N(10) of the 10-valent Xe ions has approached the peak.

Roughly eight electrons are emitted from one atom for Ar as well. The absorption cross-sectional area of photons with 13.5 nm is 1.4 Mb and is therefore relatively large. Ar is therefore less advantageous than Kr, but is cheaper than other rare gases.

Ne has an absorption cross-sectional area of photons with a 13.5 nm wavelength of 4.0 Mb, therefore a large absorption cross-sectional area of photons with a wavelength of 13.5 nm. The number of electrons which is emitted per atom is roughly 6.5 and is therefore great. In this case, a certain effect for increasing the radiation density of 13.5 nm can be assumed.

$N_2$ has an absorption cross-sectional area of photons with 13.5 nm of 2.5 Mb, therefore a large absorption cross-sectional area of photons with 13.5 nm. The number of electrons emitted per molecule is roughly 8 and is therefore great. In this case, a certain effect for increasing the radiation density of 13.5 nm can be assumed.

The absorption cross-sectional area of photons with 13.5 nm for $NH_3$ is, as for Kr, 1.2 Mb. The number of electrons emitted per molecule is roughly 7 and is therefore great. In this case, a certain effect for increasing the radiation density of 13.5 nm can be assumed.

He as one of the rare gases, however, has a small absorption cross-sectional area of photons with 13.5 nm, but the free electrons emitted are roughly 2.0 and are therefore few. In this case, an effect for increasing the radiation density of 13.5 nm cannot be expected.

Next, based on the above described formula (2), the radiation density in the case in which, of the above described substances, Kr and Ar were added to pure Xe, was determined as a function of the gas mixing amount.

Figure 2:
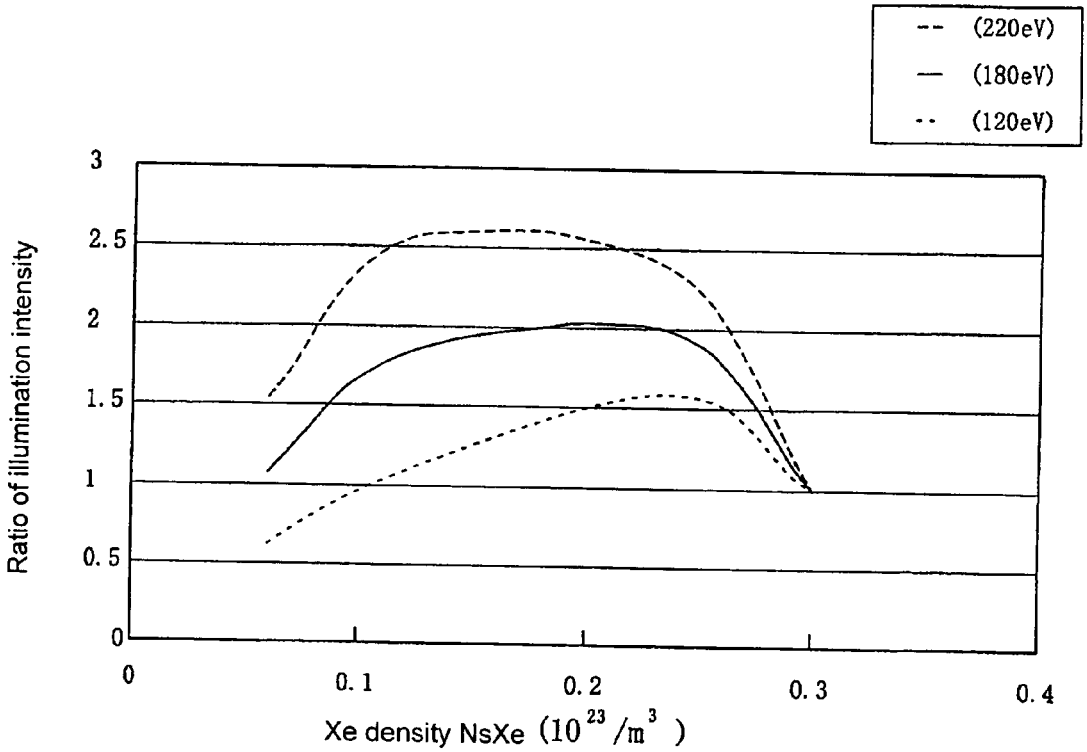
FIGS. 2(*a*) and 2(*b*) are, respectively, a plot and a table which show the ratio of the radiation intensity when the mixing ratio of Xe to Kr changes as the absorption coefficient is kept constant at an average atomic density of Xe of $0.3\times10^{23}/m^3$.
Figure 4:
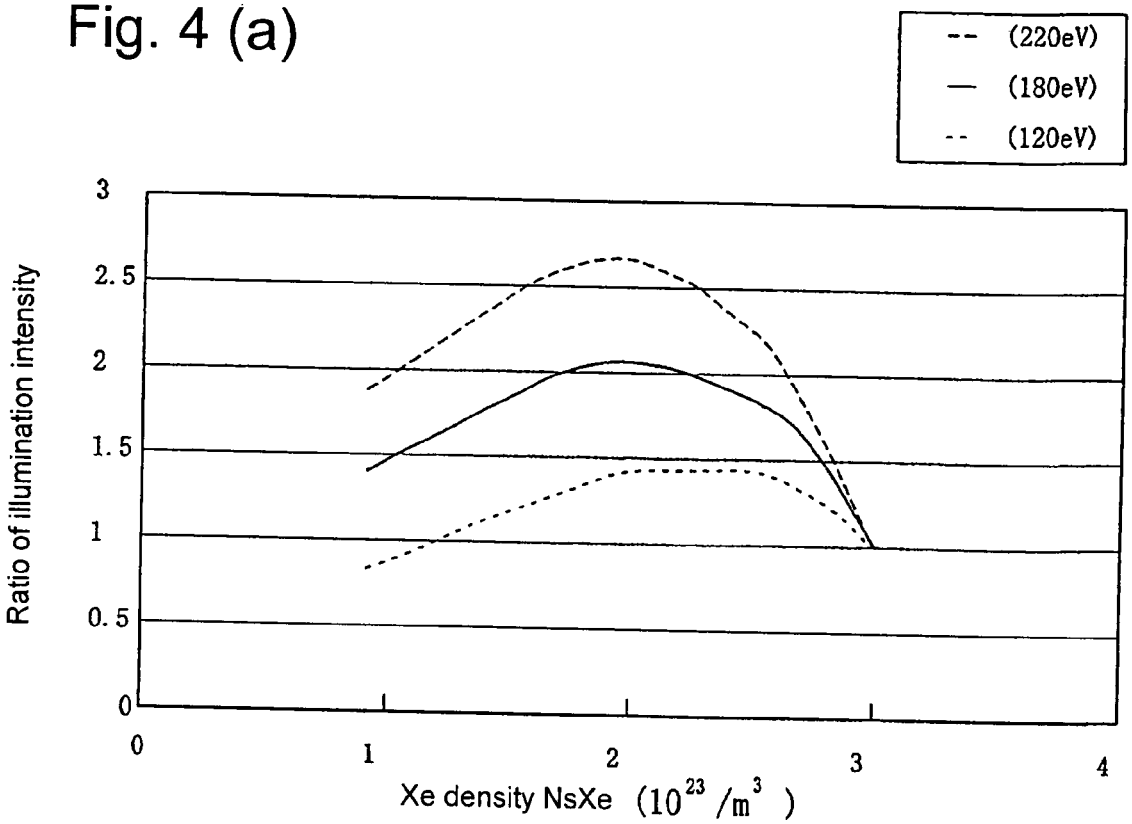
FIGS. 4(*a*) and 4(*b*) are, respectively, a plot and a table which show the ratio of the radiation intensity when the mixing ratio of Xe to Kr changes as the absorption coefficient is kept constant at an average atomic density of Xe of $3.0\times10^{23}/m^3$.
Figure 5:
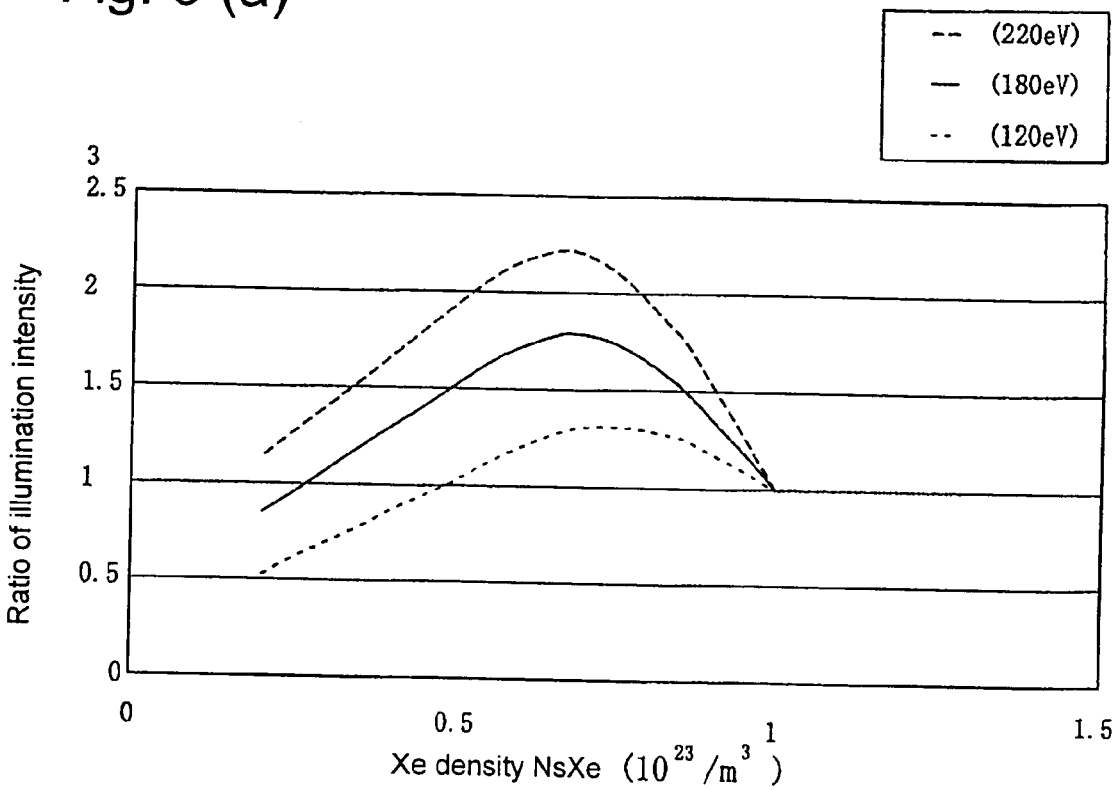
FIGS. 5(*a*) and 5(*b*) are, respectively, a plot and a table which show the ratio of the radiation intensity when the mixing ratio of Xe to Ar changes as the absorption coefficient is kept constant at an average atomic density of Xe of $1.0\times10^{23}/m^3$.

FIGS. 2(*a*) and 2(*b*) to FIGS. 4(*a*) and 4(*b*) and FIGS. 5(*a*) and 5(*b*), each show the result of computing the radiation density when the amount of mixing changes such that, while keeping the absorption coefficient constant at the density of pure xenon as a reference, the Xe density is reduced, and that for this purpose, the equilibrium is preserved such that, for the other gases, the absorption coefficients become constant.

In FIGS. 2(*a*) to 5(*a*), the x axis of the graph plots the gas density of Xe and the y axis of the graph plots the relative radiation intensity ratio at which the radiation density of the extreme UV light with a wavelength of 13.5 nm is 1, this light being emitted in the case that only pure Xe is used as an operating gas. In the respective table of FIGS. 2(*b*) to 5(*b*), the computed values are shown underneath the graph.

Here, the ionization energy of the 10-valent Xe ions is 233 eV. Since 13.5 nm light is emitted in a transition with roughly 92 eV, the difference between the higher transition energy (Eu) and the energy with a lower level (E1) is 92 eV. Therefore, as the higher transition energy of the ions when the 13.5 nm light is emitted, a value in-between is taken, and I (Te) is computed for the three values of 220 eV, 180 eV and 120 eV.

FIGS. 2(*a*) and 2(*b*) to FIGS. 4(*a*) and 4(*b*) show in graphic representations and tables the relative radiation intensity ratio in the case of mixing Kr into pure Xe.

FIGS. 2(*a*) and 2(*b*) each show the effect of the Kr mixture with respect to the increase of the intensity of the radiation of the 13.5 nm light when the density of Xe decreases in the above described gas mixture in a narrow small passage while the absorption coefficient is kept constant at an average atomic density (Ns) of Xe of $0.3\times10^{23}/m^3$ and when the amount of mixture changes while balancing such that, for this reason, the absorption coefficient for Kr gas becomes constant. Here, Eu (higher transition energy) was computed with respect to the above described assumed three levels of the 10-valent Xe ions ($Xe^{+10}$).

FIGS. 2(*a*) and 2(*b*) show, as was described above, the relative intensities with respect to the increase of the radiation density at a mixing ratio (denoted by atomic density) of Kr to Xe and for each transition level (eV). If, for example, $3.191\times10^{23}/m^3$ Kr is mixed, when Xe is $0.12\times10^{23}/m^3$, it was computed that for a transition level of Xe of, for example, 220 eV, the relative radiation density can be increased to 2.55, while the radiation density of the extreme UV light with a wavelength of 13.5 nm which is emitted in the case in which only pure Xe is used as the operating gas is 1.

Figure 3:
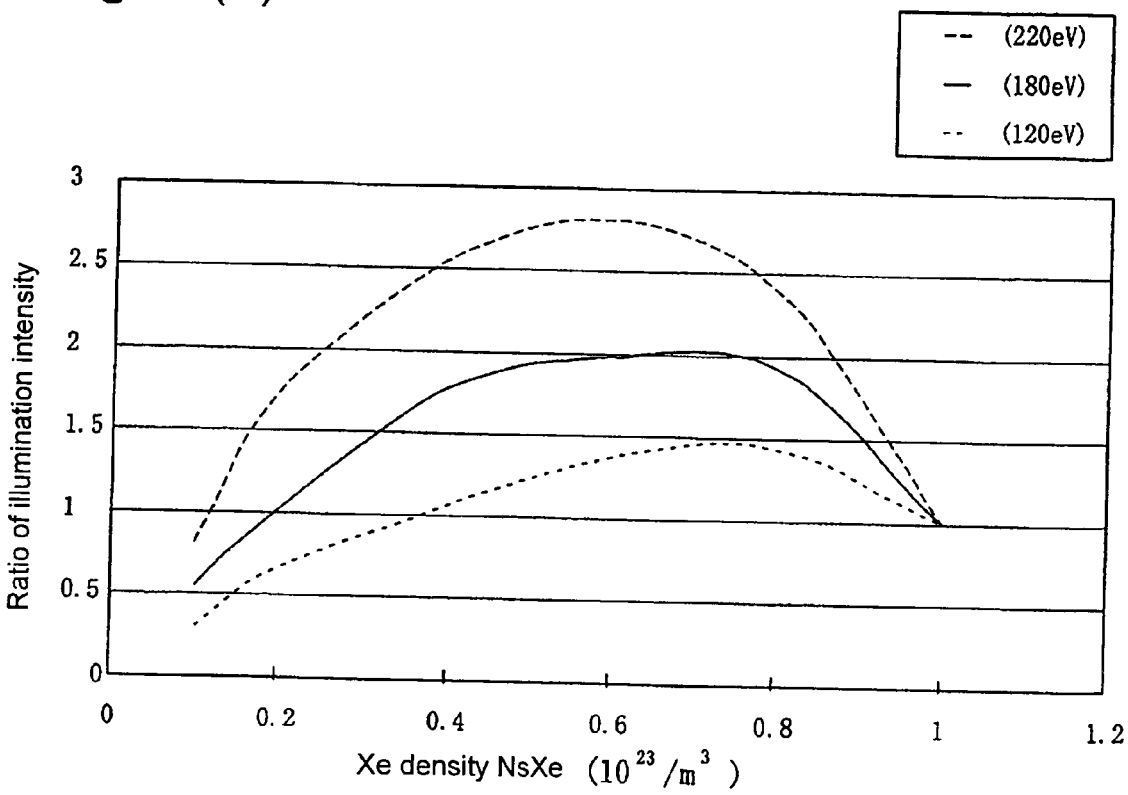
FIGS. 3(*a*) and 3(*b*) are, respectively, a plot and a table which show the ratio of the radiation intensity when the mixing ratio of Xe to Kr changes as the absorption coefficient is kept constant at an average atomic density of Xe of $1.0\times10^{23}/m^3$.

FIGS. 3(*a*) and 3(*b*) show in a graph and table the effect of a Kr mixture with respect to the increase of the intensity of radiation of 13.5 nm light when the density of Xe is reduced in the above described gas mixture in a narrow small passage while the absorption coefficient is kept constant at an average atomic density (Ns) of Xe of $1.0\times10^{23}/m^3$ and when the amount of mixture changes while balancing such that, for this reason, the absorption coefficient for Kr gas becomes constant. Here, Eu (high transition energy) was computed with respect to the above described assumed three levels of the 10-value Xe ions ($Xe^{+10}$).

FIGS. 3(*a*) and 3(*b*), as was described above, at a mixing ratio (denoted with atomic density) of Kr to Xe and for each transition level (eV), show the relative intensities with respect to the increase of the radiation density. If, for example, $7.09\times10^{23}/m^3$ Kr is mixed, when Xe is $0.6\times10^{23}/m^3$, it was computed that, for a transition level of Xe of, for example, 220 eV, the relative radiation density can be increased to 2.83, while the radiation density of the extreme UV light with a wavelength of 13.5 nm which is emitted in the case in which only pure Xe with an average atomic density of $1.0\times10^{23}/m^3$ is used as the operating gas is 1.

FIGS. 4(*a*) and 4(*b*) show in a graph and table the effect of a Kr mixture with respect to the increase of the intensity of radiation of 13.5 nm light when the density of Xe is reduced in the above described gas mixture in a narrow small passage while the absorption coefficient is kept constant at an average atomic density (Ns) of Xe of $3.0\times10^{23}/m^3$ and when the amount of mixture changes while balancing such that, for this reason, the absorption coefficient for the Kr gas becomes constant. Eu (high transition energy) was computed with respect to the assumed three levels of the 10-value Xe ions ($Xe^{+10}$).

FIGS. 4(*a*) and 4(*b*), at the mixing ratio (denoted with atomic density) of Kr to Xe and for each transition level (eV), show the relative intensities with respect to the increase of the radiation density. If, for example, $10.635\times10^{23}/m^3$ Kr is mixed, when Xe is $2.4\times10^{23}/m^3$, it was computed that, for a transition level of Xe of 220 eV, the relative radiation density can be increased to 2.36, while the radiation density of the extreme UV light with a wavelength of 13.5 nm which is emitted in the case in which only pure Xe with an average atomic density of $3.0\times10^{23}/m^3$ is used as the operating gas is 1.

FIGS. 5(*a*) and 5(*b*) show in a graph and table the effect of the Ar mixture with respect to the increase of the intensity of radiation of 13.5 nm light when the density of Xe is reduced in the above described gas mixture in a narrow small passage while the absorption coefficient is kept constant at an average atomic density (Ns) of Xe of $1.0\times10^{23}/m^3$ and when the amount of mixture changes while balancing such that, for this reason, the absorption coefficient for Ar gas becomes constant. Eu (high transition energy) was computed with respect to the assumed three levels of the 10-value Xe ions ($Xe^{+10}$).

FIGS. 5(*a*) and 5(*b*), at a mixing ratio (denoted with atomic density) of Ar to Xe and for each transition level (eV), show the relative intensities with respect to the increase of the radiation density. If, for example, $2.88\times10^{23}/m^3$ Ar is mixed, when Xe is $0.8\times10^{23}/m^3$, it was computed that, for a transition level of Xe of 220 eV, the relative radiation density can be increased to 1.94, while the radiation density of the extreme UV light with a wavelength of 13.5 nm which is emitted in the case in which only pure Xe with an ion density of $0.3\times10^{23}/m^3$is used as the operating gas is 1.

As was shown above in FIGS. 2(*a*) and 2(*b*) to FIGS. 5(*a*) and 5(*b*), it was confirmed that, by using a gas mixture for the three Xe transition levels, the radiation density of the extreme UV light can be increased, for this gas mixture, a substance having been mixed with the Xe, which substance at room temperature is molecular or atomic and which in the temperature range in which the particle density of 10-valent Xe ions ($Xe^{+10}$) becomes maximum, emits from a molecule or an atom free electrons with a number of at least half the number of electrons which are released from a Xe atom.

Figure 6:
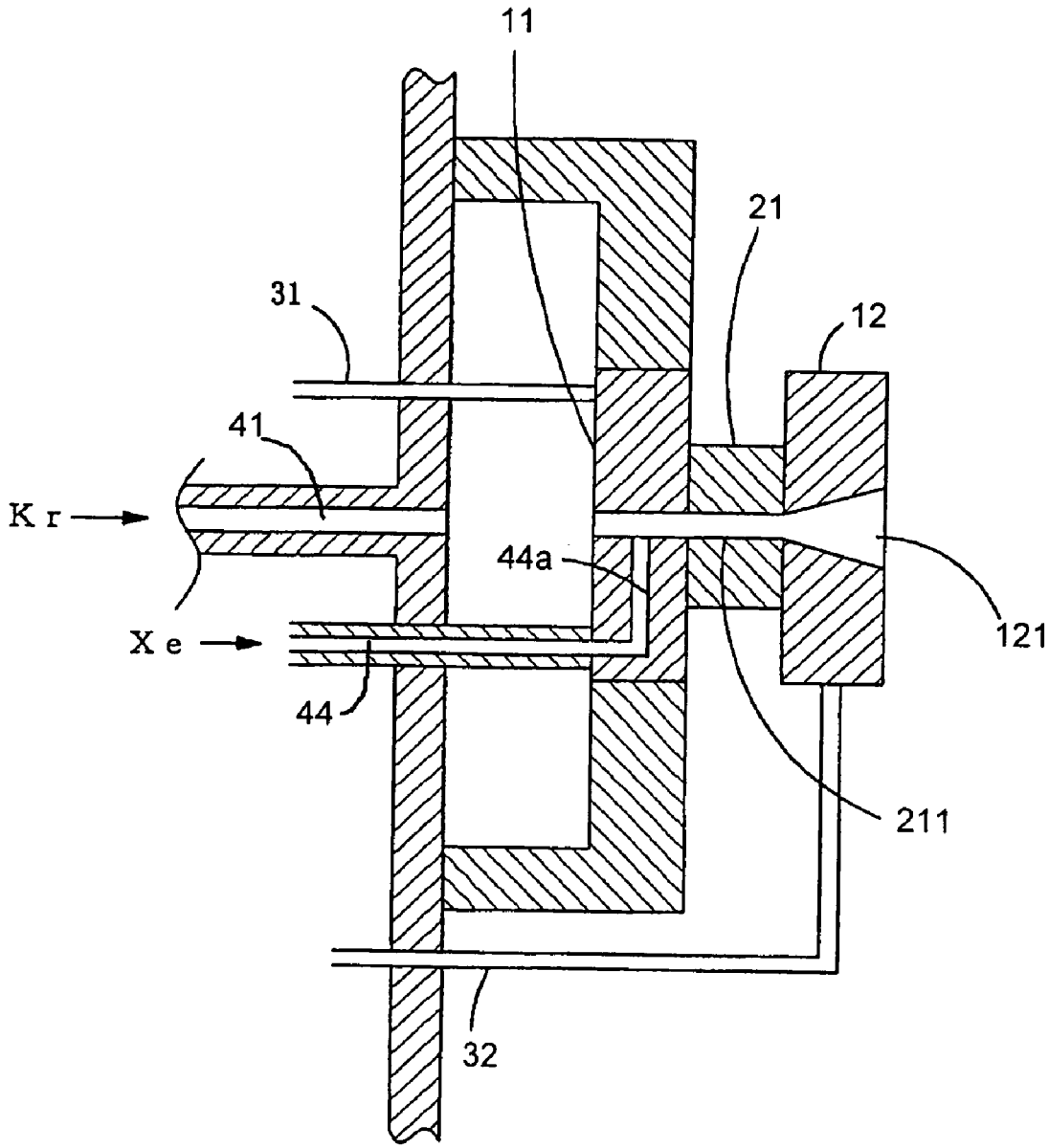
FIG. 6 is a schematic cross-sectional view of a first modified form of the arrangement as shown in FIG. 1.
Figure 7:
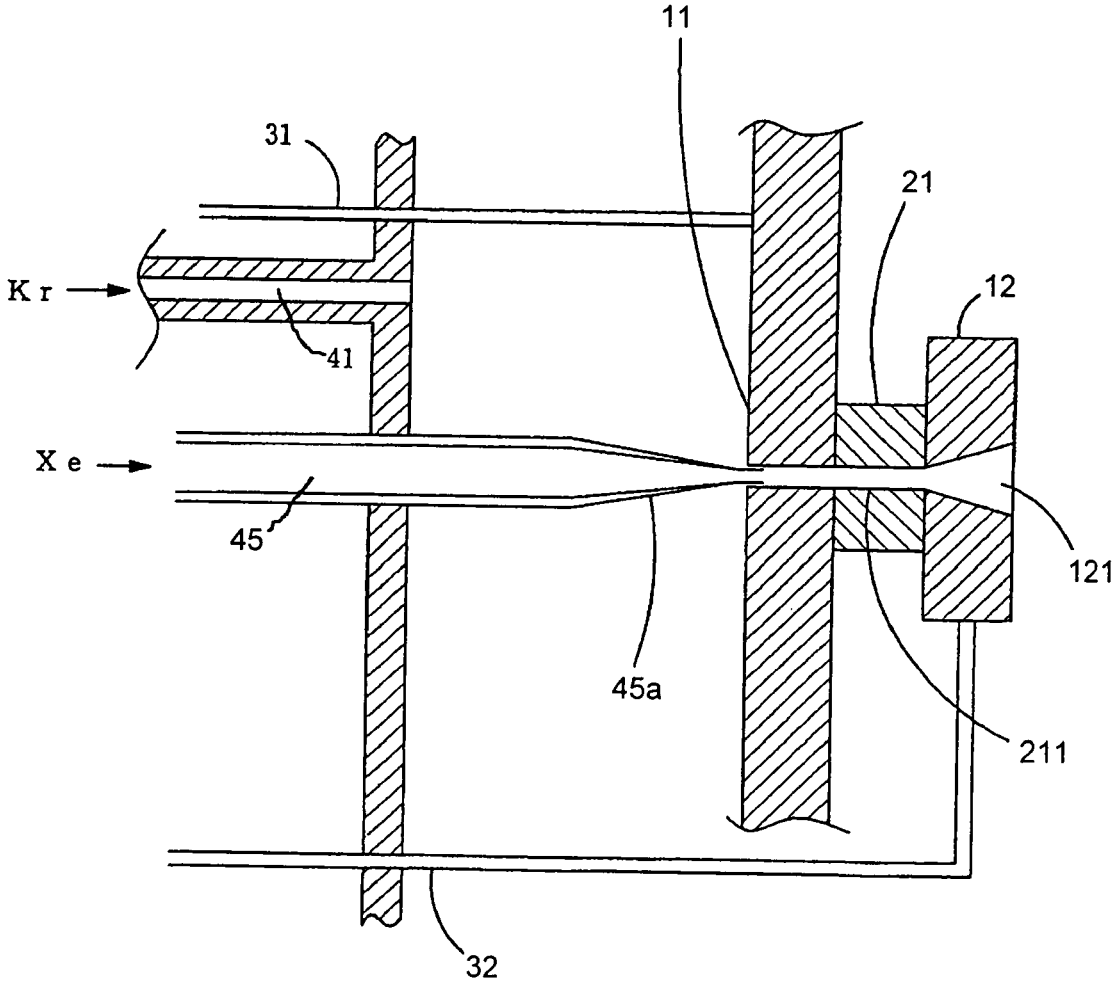
FIG. 7 shows a schematic cross-sectional view of another modified form of the arrangement as shown in FIG. 1.

FIGS. 6 and 7 each show a modification of a portion of the arrangement shown in FIG. 1. Here, the capillary 211, the electrode on the high voltage side 11, the electrode on the ground side 12 and its surrounding area are shown.

In FIG. 6, Kr gas is supplied from a gas feed opening 41 and Xe gas is supplied from a gas feed opening 44. Furthermore, Xe gas is sprayed out of a nozzle 44*a* which is located in the electrode 11 on the high voltage side and mixed with Kr gas in a small narrow passage. The other parts are identical to the parts shown above in FIG. 1.

In FIG. 7, Kr gas is supplied from a gas feed opening 41 and Xe gas is supplied from a gas feed opening 45. Furthermore, Xe gas is sprayed out of a nozzle 45*a* and mixed with Kr gas in a small narrow passage. The other parts are identical to the parts shown above in FIG. 1.

In FIG. 1, Xe gas and other gases are mixed beforehand on a preparatory basis and fed into the space Sa. However, as is shown in FIGS. 6 and 7, using a nozzle or the like, Xe gas can also be mixed directly in front of the inlet into the capillary 211.

An extreme UV light source of the capillary type was described above. It was found, in accordance with the invention, that by using a gas mixture as the operating gas, the radiation density of the wavelength of 13.5 nm can be increased, for this gas mixture a substance being mixed in the Xe, which is molecular or atomic at room temperature and which, in the temperature range in which the particle density of 10-valent Xe ions ($Xe^{+10}$) becomes maximum, emits free electrons from a molecule or an atom of a number that is at least half the number of electrons which are released from a Xe atom, and for this gas mixture, specifically at least one of the gases Ar, Kr, Ne, $N_2$ and $NH_3$ having been mixed with Xe. Therefore, the invention can also be used for an extreme UV light source of the plasma focus type, for an extreme UV light source of the Z pinch type and for an extreme UV light source of the hollow cathode tube type. For these extreme UV light sources, an improvement of the radiation density of a wavelength of 13.5 can be expected.

Figure 8:
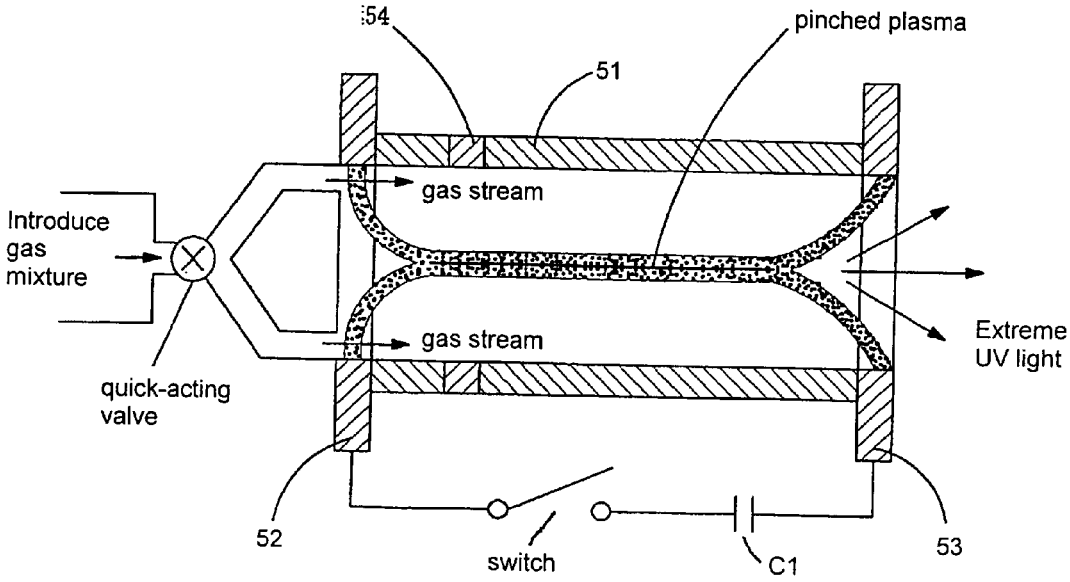
FIG. 8 is a schematic of important parts of an extreme UV light source of the Z pinch type.

FIG. 8 shows the major parts of an extreme UV light source of the Z pinch type. As is shown in FIG. 8, the important parts of the extreme UV light source of the Z pinch type have an arrangement in which there is a pair of electrodes 52, 53 on the two ends of a cylindrical or corner cylindrical discharge vessel 51. The discharge vessel 51 is made of an insulator. For this insulator, under certain circumstances, the vessel wall of the device in which the discharge vessel is located can feasibly be used. In this case, at least one of the electrodes and the power feed part are electrically insulated from this vessel wall.

From the side which is opposite the end from which the 13.5 nm light is emitted, as was described above, for example, a gas mixture of Xe and Kr is sprayed into a hollow cylindrical shape into the discharge vessel 51 in a certain amount. Simultaneously with injection, a high frequency voltage is applied to the high frequency auxiliary electrode for ionization 54. The high frequency discharge ionizes the injected gas by way of preparation. Immediately afterwards, the main discharge is started and rapid rising of the discharge current takes place.

A large current flows relatively near the wall of the discharge vessel where many electron-ion pairs are present which have been formed by auxiliary ionization, and at the same time, an induction magnetic field is formed. Due to the Lorentz force which is formed by this current and the magnetic field, the plasma is compressed in the axial direction of the discharge vessel, by which the density and the temperature of the plasma increase and by which strong 13.5 nm light is emitted. When the current from a capacitor C1 decreases, the compression also decreases until finally the discharge is also ended. The above described process is repeated and is carried out with a high speed (a few kHz).

Figure 9:
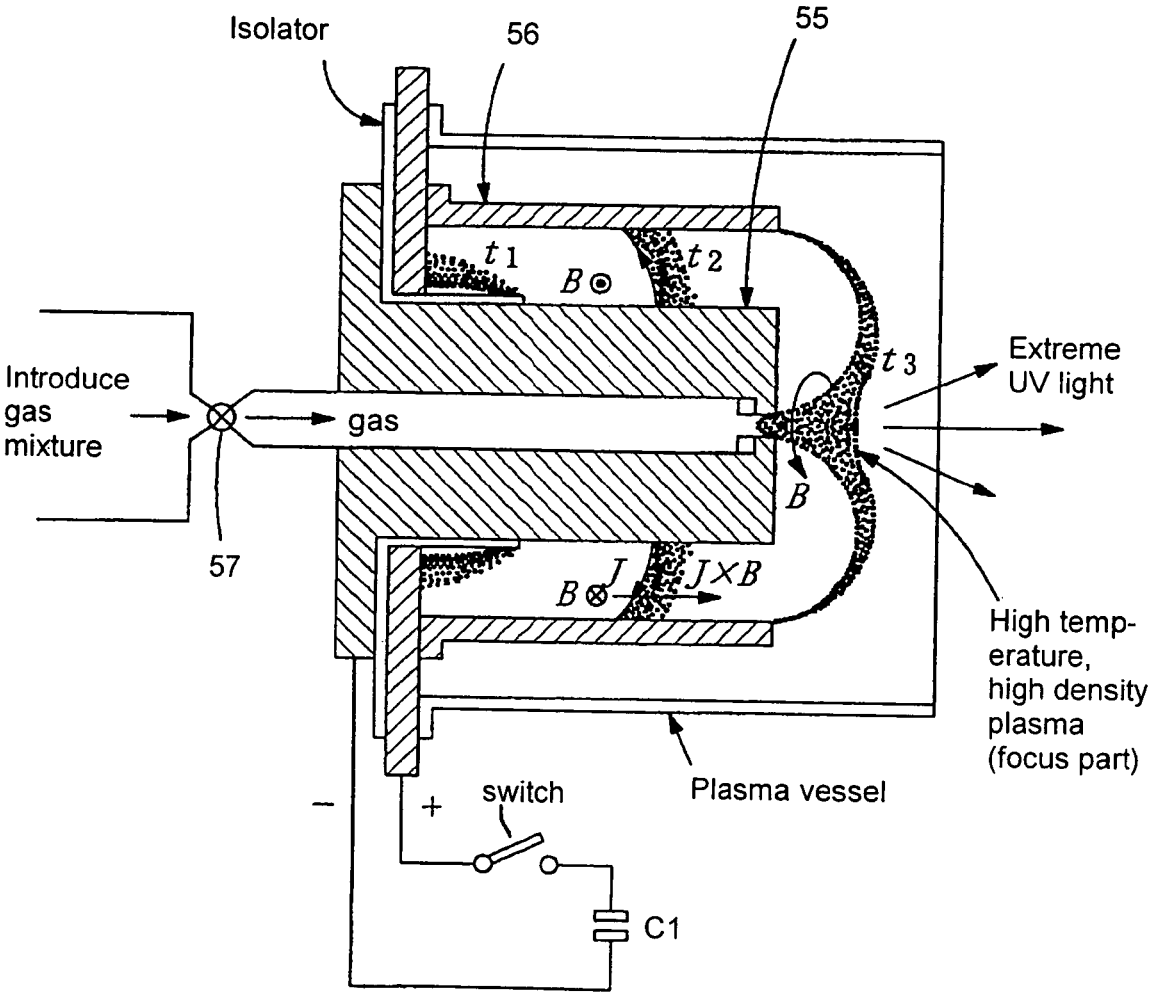
FIG. 9 is a schematic of important parts of an extreme UV light source of the plasma focus type.

FIG. 9 shows important parts of an extreme UV light source of the plasma focus type. Here, an inside electrode (normally an anode) 55 and an outside electrode (normally a cathode) 56 are arranged concentrically. The two electrodes are electrically separated from one another by an insulating wall. This wall extends in the manner of a layer on the outside surface of the inside electrode.

First, a quick operating valve 57 is opened and a gas mixture of Xe and Kr in a certain amount is fed into the discharge part. Afterwards, the main discharge is started. When the charging voltage of the capacitor C1 is applied to the inside electrode and the outside electrode, on the surface of the insulating layer an insulation breakdown is formed, by which the discharge begins.

In FIG. 9, the time t1 shows the stage of the start of the discharge, t2 shows the stage of plasma acceleration and t3 shows the stage of focus formation. Here t1<t2<t3. J denotes the discharge current, B the magnetic field and J×B the electromagnetic Lorentz force.

When a large current starts to flow, an induction magnetic field is formed by a closed circuit which is formed by the capacitor C1—the anode 55—the plasma—the cathode 56—the capacitor C1 (t1 in FIG. 9). By this magnetic field and the plasma stream, a Lorentz force is exerted on the plasma (in FIG. 9, the force which is directed toward the right).

With this force, the plasma moves quickly to the right (t2). When the plasma reaches the anode tip, a force which is pointed toward the middle of the anode is exerted on the plasma on the anode surface. When it has moved to the middle of the anode, it is compressed in the manner of a point, by which high radiation density occurs (t3). After the plasma disappears, the above described process is repeated with high speed.

The average atomic density of the Xe of the focus part of this extreme UV light source of the plasma focus type is computed, for example, using the process described in "Line Broadening Studies in Low Energy Plasma Focus" (P. Meenakshi Raja Rao and seven other authors, Pramana-J. Phys., vol. 132, no. 5, May 1989, pp. 627 to 639).

Figure 10:
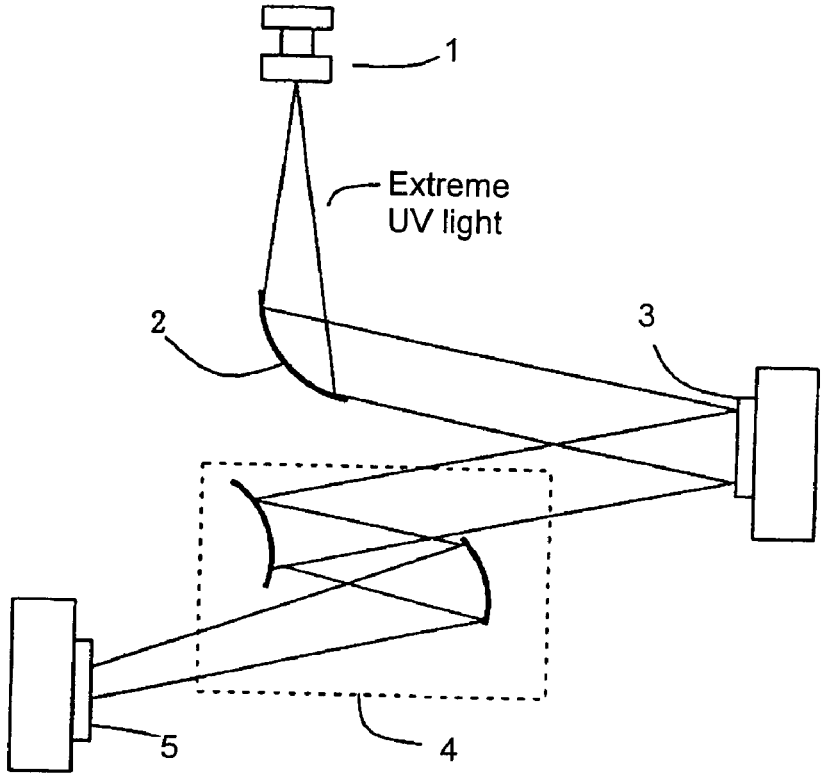
FIG. 10 is a schematic of an example of an arrangement in which a semiconductor exposure device was arranged using an extreme UV light source in accordance with the invention.

FIG. 10 shows an example of an arrangement for forming a semiconductor exposure device using the above described extreme UV light source. In the semiconductor exposure device using the above described extreme UV light source, as was described above, in a vacuum vessel using a capillary discharge or the like, there are an extreme UV light source 1, a focusing mirror 2 in which the reflection surface is provided with a multilayer film, a mask of the reflection type 3, a projection optics system 4, a wafer 5 and the like.

The extreme UV light emitted from the extreme UV light source 1 is focused by means of the focusing mirror 2 and is emitted onto the mask of the reflection type 3. The light reflected from the mask 3 is subject to reduction projection via the projection optics system 4 onto the surface of the wafer 5.

In the focusing mirror 2, on a metallic substrate with a small coefficient of thermal expansion, a multilayer film of Si and Mo is formed. In the mask of the reflection type 3, the quartz glass is provided with a multilayer film of Mo and Si. In the projection optics system 4, the reflectors are combined with one another, for each of which a respective multilayer film of Si and Mo is formed on a metallic substrate with a small coefficient of thermal expansion.

Action of the Invention

As was described above, the following effects can be obtained with the invention:

(1) For an extreme UV light source using extreme UV radiation in which, in the xenon (Xe) gas, a high current discharge takes place and plasma is produced, and in which 10-valent Xe ions ($Xe^{10+}$) are formed and emitted in this plasma, a substance is mixed into the Xe which, at room temperature, is molecular or atomic and which, in the temperature range in which the particle density of 10-valent Xe ions ($Xe^{+10}$) becomes maximum, emits a number of free electrons from a molecule or an atom that is at least half the number of electrons which are released from a Xe atom. In this way, without increasing the Xe density, the temperature at which the radiation density is maximum can be shifted to the high temperature side according to the increase of the mixing ratio. In this way, the radiation density of the 13.5 nm light can be increased.

(2) Since krypton (Kr) has a large absorption cross-sectional area of photons of 13.5 nm light and also a large number of free electrons, it is extremely effective when krypton (Kr) is mixed into xenon (Xe) gas as the operating gas. This means that an increase of the gas pressure is enabled when the absorption coefficient is made identical to that for the pure Xe gas. Thus, the diameter of the opening of the narrow passage can be increased and the pressure difference of differential evacuation can be reduced. Furthermore, the disadvantage of enlargement of the evacuation device can also be prevented.

(3) Since argon (Ar) has a large absorption cross-sectional area of photons of 13.5 nm wavelength light and also a large number of free electrons, it is also effective to mix argon (Ar) into xenon as the operating gas. In the case of argon, as in the case of Kr, an increase of the operating gas pressure is also enabled when the absorption coefficient is identical to that in pure Xe. Thus, the diameter of the opening of the narrow passage can be increased and the pressure difference of the differential evacuation can be reduced. Furthermore, the amount of emergence of extreme UV light is increased. The disadvantage of enlarging the evacuation device can be prevented.

(4) Furthermore, for Ne, $N_2$, $NH_3$ the same effect as in Kr and Ar can also be expected. Kr, Ar, Ne, $N_2$, $NH_3$ are cheaper, and therefore, more economical than Xe.

(5) By using the extreme UV light source in accordance with the invention for a semiconductor exposure device, the possibility of practical use for semiconductor exposure of an extremely fine semiconductor can be increased. In this extreme UV light source of the invention, pure Xe is not used as the operating gas, but rather in a gas mixture, extreme UV radiation with 13.5 nm being emitted. The substance that is mixed in is one which is molecular or atomic at room temperature and which, in the temperature range in which the particle density of 10-valent Xe ions ($Xe^{+10}$) becomes maximum, emits a number of free electrons from a molecule or an atom that is at least half the number of electrons which are released from a Xe atom, e.g., at least one of the gases Kr, Ar, Ne, $N_2$, $NH_3$ is mixed with Xe.

What is claimed is:

1. Extreme UV light source, comprising:

means for producing a plasma from a gas mixture of Xe and a substance which is molecular or atomic at room temperature and which, in a temperature range in which 10-valent Xe ions ($Xe^{10+}$) occur, emits a number of free electrons from a molecule or an atom that is at least half the number of electrons which are released from a Xe atom and for emitting extreme UV radiation with a wavelength of 13.5 nm from 10-valent Xe ions ($Xe^{10+}$) which form in said plasma.

2. Extreme UV light source according to claim 1, wherein said substance comprises at least one of the gases Ar, Kr, Ne, $N_2$ and $NH_3$.

3. Extreme UV light source as claimed in claim 1, wherein said means for producing comprises a first electrode and a second electrode, and wherein a narrow small passage is provided for passage of the gas mixture.

4. Extreme UV light source as claimed in claim 3, wherein the average atomic density of Xe in the above described gas mixture in the above described narrow, small passage is at least $2.4\times10^{22}/m^3$.

5. Extreme UV light source as claimed in claim 3, wherein said means for emitting is adapted to cause extreme UV radiation to be admitted in a direction of flow of the gas mixture in the narrow small passage.

6. Extreme UV light source as claimed in claim 5, further comprising a means for producing said gas mixture upstream of said narrow small passage.

7. Extreme UV light source as claimed in claim 6, further comprising a space from which gas is supplied to the narrow small passage, means for filling the space with an atmosphere with at least one of the gases Ar, Kr, Ne, $N_2$ and $NH_3$, and means for mixing Xe into said at least one of the gases Ar, Kr, Ne, $N_2$ and $NH_3$ upstream of said narrow small passage.

8. Extreme UV light source as claimed in claim 6, further comprising a space from which gas is supplied to the narrow small passage, means for filling the space with a Xe atmosphere, and means for mixing in at least one of the gases Ar, Kr, Ne, $N_2$ and $NH_3$ upstream of the narrow small passage.

9. Extreme UV light source as claimed in claim 3, further comprising a means for producing said gas mixture upstream of said narrow small passage.

10. Extreme UV light source as claimed in claim 9, further comprising a space from which gas is supplied to the narrow small passage, means for filling the space with an atmosphere with at least one of the gases Ar, Kr, Ne, $N_2$ and $NH_3$, and means for mixing Xe into said at least one of the gases Ar, Kr, Ne, $N_2$ and $NH_3$ upstream of said narrow small passage.

11. Extreme UV light source as claimed in claim 3, further comprising a space from which gas is supplied to the narrow small passage, means for filling the space with an atmosphere with at least one of the gases Ar. Kr, Ne, $N_2$ and $NH_3$, and means for mixing Xe into said at least one of the gases Ar, Kr, Ne, $N_2$ and $NH_3$ upstream of said narrow small passage.

12. Extreme UV light source as claimed in claim 3, further comprising a space from which gas is supplied to the narrow small passage, means for filling the space with a Xe atmosphere, and means for mixing in at least one of the gases Ar, Kr, Ne, $N_2$ and $NH_3$ upstream of the narrow small passage.

13. Extreme UV light source as claimed in claim 3, further comprising a space from which gas is supplied to the narrow small passage, means for filling the space with a Xe atmosphere, and means for mixing in at least one of the gases Ar, Kr, Ne, $N_2$ and $NH_3$ upstream of the narrow small passage.

14. Extreme UV light source as claimed in claim 1, wherein said means for producing comprises a first electrode and a second electrode, wherein the extreme UV light source is a Z pinch light source having a cylindrical vessel which is located between the first electrode and the second electrode for delivering the gas mixture, and wherein the average atomic density of Xe in the gas mixture in this cylindrical vessel is at least $2.4\times10^{22}/m^3$.

15. Extreme UV light source as claimed in claim 1, wherein the extreme UV light source is a plasma focus light source, wherein an outside cylindrical electrode and an inside cylindrical electrode are concentrically arranged, wherein the inside cylindrical electrode has a central through opening for feeding said gas mixture, and wherein the average atomic density of Xe in the gas mixture of a focus part of high temperature plasma formed in a gas emission-side tip area of the inside cylindrical electrode is at least $2.4\times10^{22}/m^3$.

16. Extreme UV light source as claimed in claim 1, wherein light source has an inlet for receiving the gas mixture.

17. Extreme UV light source as claimed in claim 16, wherein said inlet is connected to a chamber, wherein said chamber is provided with means for evacuating gas therefrom, and wherein a narrow small passage is provided is connected to said chamber for receiving said mixture, and wherein said means for producing comprises a first electrode and a second electrode.

18. Semiconductor exposure device, comprising an extreme UV light source having means for producing a plasma from a gas mixture of Xe and a substance which is molecular or atomic at room temperature and which, in a temperature range in which 10-valent Xe ions ($Xe^{10+}$) occur, emits a number of free electrons from a molecule or an atom that is at least half the number of electrons which are released from a Xe atom and for emitting extreme UV radiation with a wavelength of 13.5 nm from 10-valent Xe ions ($Xe^{10+}$) which form in said plasma, at least one reflector and a mask.

19. Semiconductor exposure device as claimed in claim 18, wherein said means for producing comprises a first electrode and a second electrode, and wherein a narrow small passage is provided for passage of the gas mixture.

20. Semiconductor exposure device as claimed in claim 19, further comprising a means for producing said gas mixture upstream of said narrow small passage.

21. Semiconductor exposure device as claimed in claim 20, further comprising a space from which gas is supplied to the narrow small passage, means for filling the space with an atmosphere with at least one of the gases Ar, Kr, Ne, $N_2$ and $NH_3$, and means for mixing Xe into said at least one of the gases Ar, Kr, Ne, $N_2$ and $NH_3$ upstream of said narrow small passage.

22. Semiconductor exposure device as claimed in claim 20, further comprising a space from which gas is supplied to the narrow small passage, means for filling the space with a Xe atmosphere, and means for mixing in at least one of the gases Ar, Kr, Ne, $N_2$ and $NH_3$ upstream of the narrow small passage.

23. Semiconductor exposure device as claimed in claim 18, wherein light source has an inlet for receiving the gas mixture.

24. Semiconductor exposure device as claimed in claim 23, wherein said inlet is connected to a chamber, wherein said chamber is provided with means for evacuating gas therefrom, and wherein a narrow small passage is provided is connected to said chamber for receiving said mixture, and wherein said means for producing comprises a first electrode and a second electrode.

* * * * *